US010323868B2

(12) United States Patent
Winters et al.

(10) Patent No.: US 10,323,868 B2
(45) Date of Patent: Jun. 18, 2019

(54) MULTI-COIL MICROCHANNEL EVAPORATOR

(71) Applicant: TRANE INTERNATIONAL INC., Davidson, NC (US)

(72) Inventors: Justin S. Winters, Adams, TN (US); Doyle R. Goodman, Clarksville, TN (US); Brandy L. Harper, Clarksville, TN (US); Jun Wang, Shang Hai (CN); Robert Fredrick Schult, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/426,216

(22) Filed: Feb. 7, 2017

(65) Prior Publication Data

US 2017/0227266 A1 Aug. 10, 2017

Related U.S. Application Data

(60) Provisional application No. 62/292,666, filed on Feb. 8, 2016.

(51) Int. Cl.

| | |
|---|---|
| ***F28D 1/04*** | (2006.01) |
| ***F28F 9/02*** | (2006.01) |
| ***F25B 39/00*** | (2006.01) |
| ***F25B 39/02*** | (2006.01) |

(Continued)

(52) U.S. Cl.

CPC ..... *F25B 39/00* (2013.01); *F25B 41/003* (2013.01); *F28D 1/0417* (2013.01); *F28D 1/0443* (2013.01); *F28F 9/0275* (2013.01); *F25B 39/028* (2013.01); *F25B 2400/0751* (2013.01); *F28D 2021/0071* (2013.01); *F28F 2260/02* (2013.01)

(58) Field of Classification Search

CPC .... F25B 39/00; F25B 41/0003; F25B 39/028; F28D 1/05383; F28D 1/05316; F28F 27/02; F28F 1/022; F28F 2210/02

See application file for complete search history.

(56) References Cited

U.S. PATENT DOCUMENTS

| | | | |
|---|---|---|---|
| 5,765,393 | A | 6/1998 | Shlak et al. |
| 6,988,538 | B2 | 1/2006 | Merkys et al. |
| 7,963,097 | B2 | 6/2011 | Mastronarde |

(Continued)

*Primary Examiner* — Elizabeth J Martin

(74) *Attorney, Agent, or Firm* — Hamre, Schumann, Mueller & Larson, P.C.

(57) ABSTRACT

Apparatuses, systems and methods implementing a multi-coil heat exchanger are directed to providing good heat transfer performance, capacity, and efficiency, and while reducing pressure drop through multi-coil microchannel evaporators. The multi-coil heat exchanger in some examples is a multi-coil microchannel evaporator. The multi-coil microchannel evaporator can be implemented in a refrigerant system that is a single circuit, where the multi-coil microchannel evaporator is an air to refrigerant type heat exchanger. The multi-coil microchannel evaporator includes a distribution to the multiple coils of the multi-coil microchannel evaporator, where the distribution includes one or more separations to transmit refrigerant to each of the coils of the multi-coil microchannel evaporator and one or more junctions to transmit refrigerant from the coils.

11 Claims, 3 Drawing Sheets

(51) Int. Cl.
*F25B 41/00* (2006.01)
*F28D 21/00* (2006.01)

(56) References Cited

U.S. PATENT DOCUMENTS

| | | | | |
|---|---|---|---|---|
| 8,113,270 | B2 | 2/2012 | Rios et al. | |
| 8,118,084 | B2 | 2/2012 | Harvey et al. | |
| 8,166,776 | B2 | 5/2012 | Kopko et al. | |
| 8,881,541 | B2 | 11/2014 | Noll et al. | |
| 8,913,391 | B2 | 12/2014 | Ling et al. | |
| 2006/0130517 | A1* | 6/2006 | Merkys | F25B 39/022 62/515 |
| 2008/0296005 | A1* | 12/2008 | Taras | F25B 13/00 165/173 |
| 2009/0183867 | A1* | 7/2009 | Bales | F28D 7/1607 165/299 |
| 2009/0277197 | A1* | 11/2009 | Gambiana | F25B 39/028 62/115 |
| 2012/0291998 | A1 | 11/2012 | Anderson | |
| 2013/0091874 | A1 | 4/2013 | Sillato et al. | |
| 2013/0333401 | A1 | 12/2013 | Long et al. | |
| 2016/0334129 | A1* | 11/2016 | Shinoda | F24F 13/222 |

* cited by examiner

MULTI-COIL MICROCHANNEL EVAPORATOR

FIELD

Embodiments disclosed herein generally relate to providing good heat transfer performance and efficiency and reducing pressure drop through microchannel coil evaporators. In particular, apparatuses, systems and methods are directed to providing good heat transfer performance, capacity, and efficiency, and while reducing pressure drop through multi-coil microchannel evaporators.

BACKGROUND

Single circuit refrigerant systems, for example using an air to refrigerant heat exchanger as an evaporator can be susceptible to higher than desired pressure drop, which can impact maximum heat transfer performance from being achieved thereby affecting capacity and/or efficiency. Use of a single microchannel evaporator in such systems for example in applications of relatively high capacity (e.g. tonnage) can be susceptible to such effects.

SUMMARY

Embodiments disclosed herein generally relate to providing good heat transfer performance and efficiency and reducing pressure drop through microchannel coil evaporators. In particular, apparatuses, systems and methods are directed to providing good heat transfer performance, capacity, and efficiency, and while reducing pressure drop through multi-coil microchannel evaporators.

In an embodiment, methods, systems, and apparatuses are described that include the use of a multi-coil microchannel evaporator.

In an embodiment, the multi-coil microchannel evaporator is implemented in a refrigerant system that is a single circuit. A refrigerant system of a single circuit includes one or more compressors, a condenser, an evaporator, and an expansion device. In an embodiment, a single circuit includes a single working fluid, e.g. refrigerant, refrigerant blend.

In an embodiment, the multi-coil microchannel evaporator is an air to refrigerant type heat exchanger.

In an embodiment, the multi-coil microchannel evaporator includes a distribution to the multiple coils of the multi-coil microchannel evaporator.

In an embodiment, the distribution to the multi-coil microchannel evaporator includes one or more separations to transmit refrigerant to each of the coils of the multi-coil microchannel evaporator and one or more junctions to transmit refrigerant from the coils.

In an embodiment, the multi-coil microchannel evaporator has an even number of coils. In an embodiment, the multi-coil microchannel evaporator has its coils configured to be assembled to a height of about six feet tall and to a width of about eight feet wide. In an embodiment, the coils of the multi-coil microchannel evaporator are of similar or the same size.

In an embodiment, the distribution utilizes the number and size of each coil in the multi-coil microchannel evaporator to obtain a desired, targeted, and/or optimal refrigerant distribution.

In an embodiment, a method of refrigerant flow through a single circuit refrigerant system includes distributing refrigerant to coils of a multi-coil microchannel evaporator.

DRAWINGS

These and other features, aspects, and advantages of the multi-coil evaporator will become better understood when the following detailed description is read with reference to the accompanying drawings.

While the above-identified figures set forth particular embodiments of a multi-coil evaporator, other embodiments are also contemplated, as noted in the descriptions herein. In all cases, this disclosure presents illustrated embodiments of a multi-coil evaporator by way of representation but not limitation. Numerous other modifications and embodiments can be devised by those skilled in the art which fall within the scope and spirit of the principles of a multi-coil evaporator described and illustrated herein.

DETAILED DESCRIPTION

Embodiments disclosed herein generally relate to providing good heat transfer performance and efficiency and reducing pressure drop through microchannel coil evaporators. In particular, apparatuses, systems and methods are directed to providing good heat transfer performance, capacity, and efficiency, and while reducing pressure drop through multi-coil microchannel evaporators.

Figure 1:
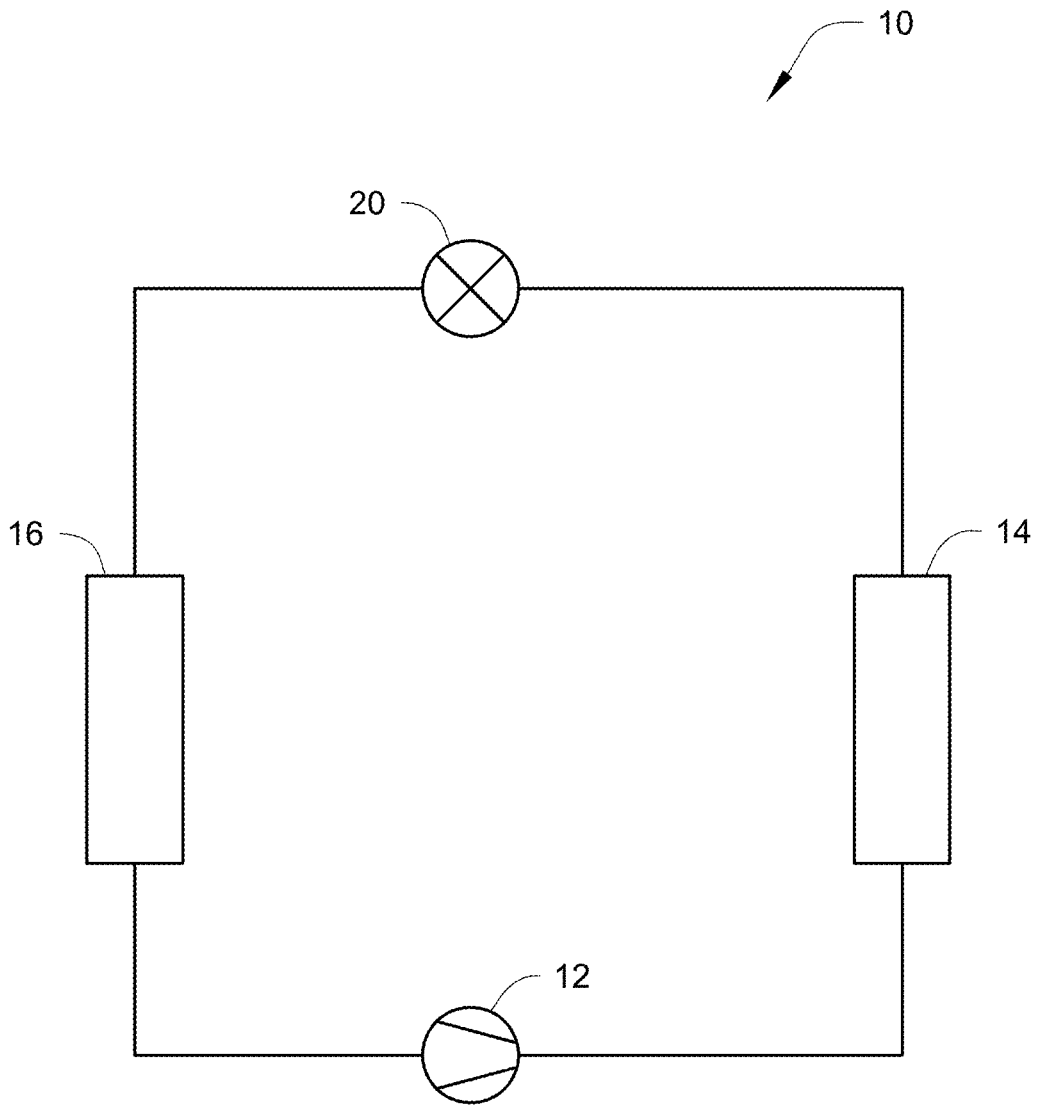
FIG. 1 is a schematic diagram of a refrigerant circuit, according to an embodiment.

FIG. 1 is a schematic diagram of a heat transfer or refrigerant circuit 10, according to an embodiment. The refrigerant circuit 10 generally includes a compressor 12, a condenser 14, an expansion device 20, and an evaporator 16. The refrigerant circuit 10 is exemplary and can be modified to include additional components. For example, in an embodiment the refrigerant circuit 10 can include other heat exchangers such as for example an economizer heat exchanger, one or more flow control devices, a receiver tank, a dryer, a suction-liquid heat exchanger, or the like. In an embodiment, the refrigerant circuit 10 can include a plurality of compressors 12. In an embodiment, the plurality of compressors 12 can include compressors having the same or different capacities.

The refrigerant circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

Figure 2:
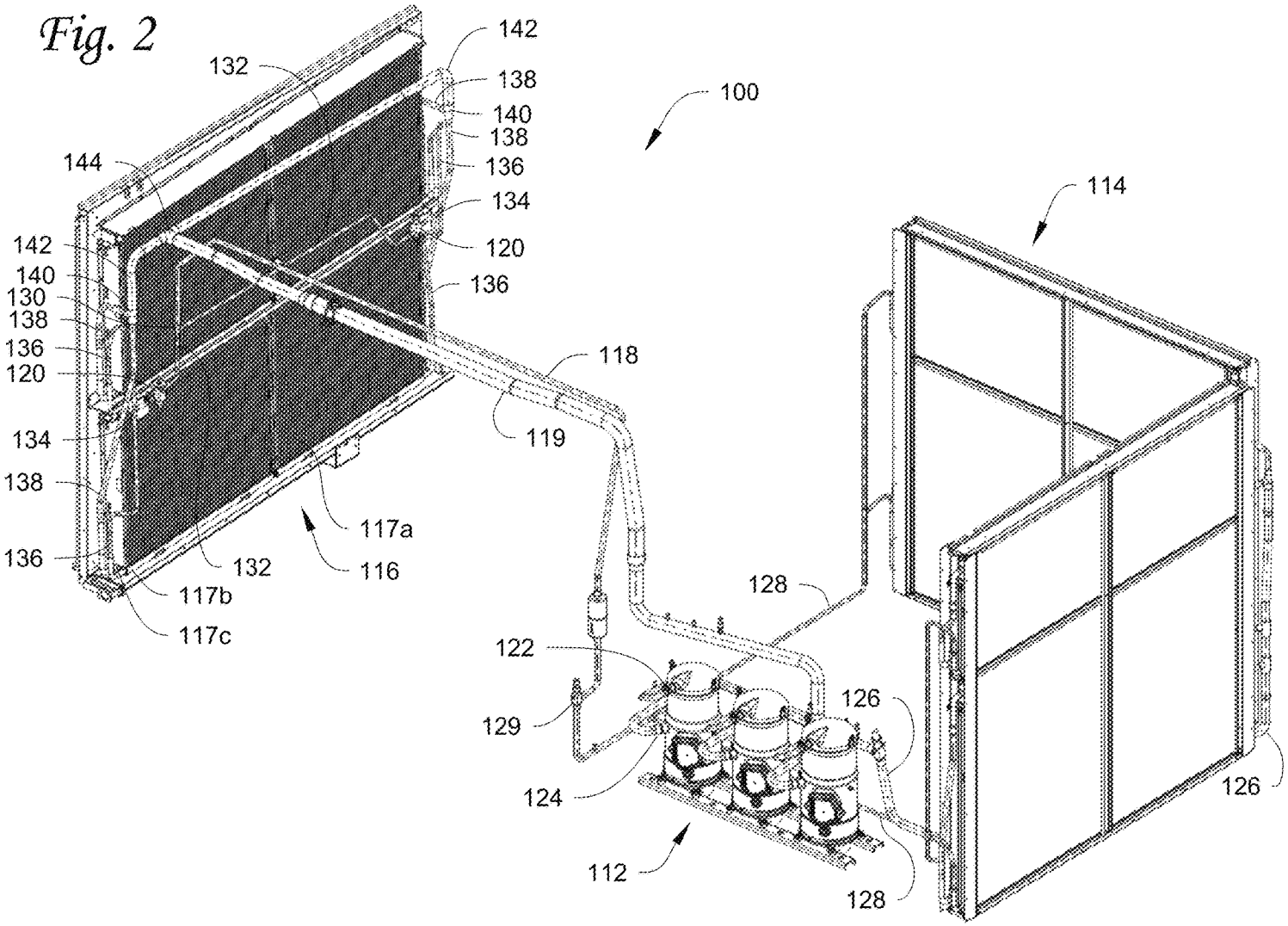
FIG. 2 is a perspective view of an embodiment of a refrigerant circuit with a multi-coil evaporator.
Figure 3:
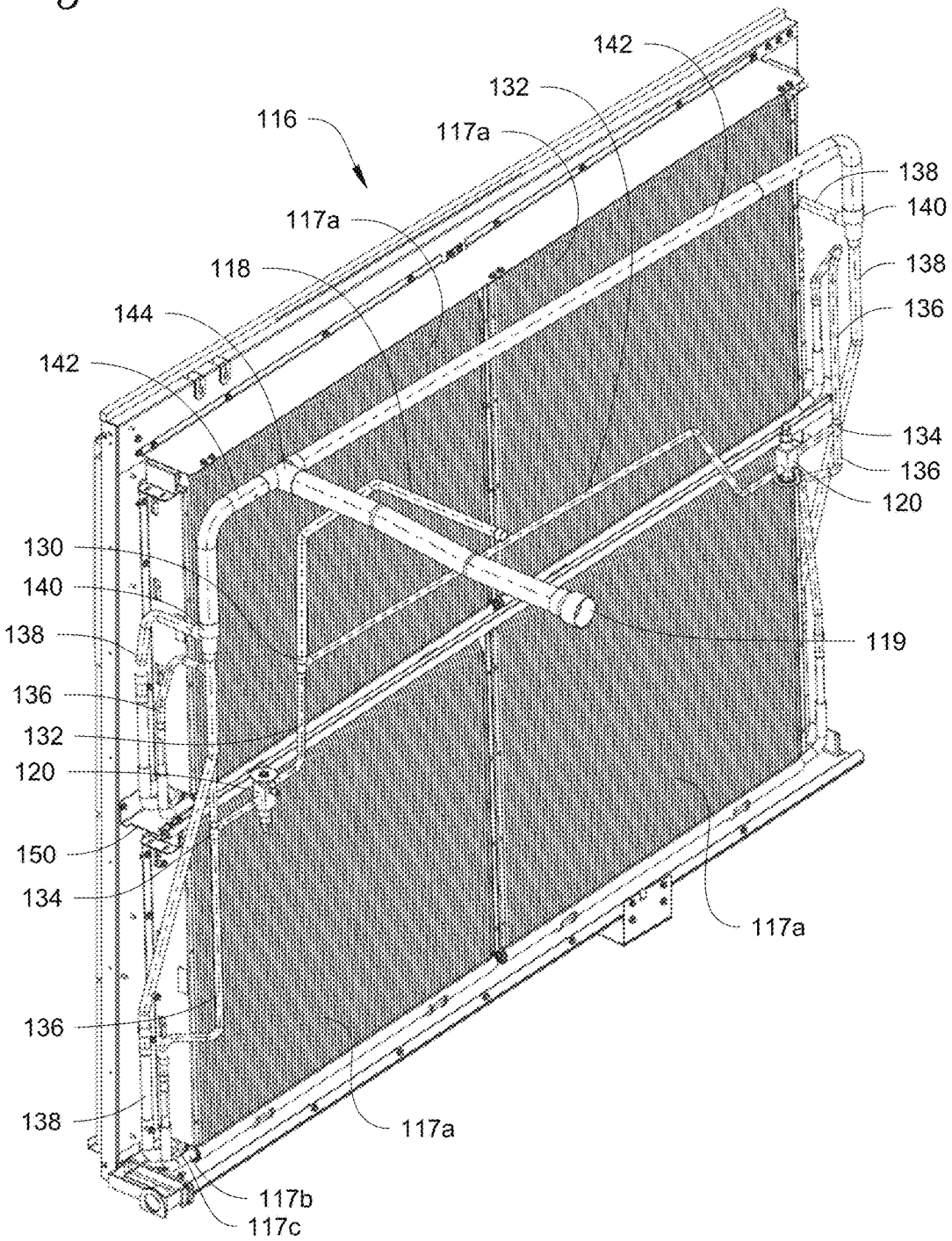
FIG. 3 is a perspective view of the multi-coil evaporator of FIG. 2.

FIGS. 2 and 3 respectively show a refrigerant circuit 100 with a multi-coil evaporator 116 and the multi-coil evaporator 116 alone.

The refrigerant circuit 100 includes a compressor 112, a condenser 114, an expansion device 120, and the multi-coil evaporator 116 (hereafter evaporator 116). A refrigerant flows through the refrigerant circuit as a working fluid. As with the refrigerant circuit 10, the refrigerant circuit 100 is also exemplary and can be modified to include additional components. For example, in an embodiment the refrigerant circuit 100 can include other heat exchangers such as for example an economizer heat exchanger, one or more flow control devices, a receiver tank, a dryer, a suction-liquid heat exchanger, or the like.

The refrigerant circuit 100 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

In an embodiment such as shown in FIG. 2, the refrigerant circuit 100 includes a plurality of compressors 112. In an embodiment, the plurality of compressors 112 can include compressors having the same or different capacities. Three compressors 112 are shown, such as for example scroll compressors, however, it will be appreciated that more or less than three compressors may be implemented in the refrigerant circuit 100. It will also be appreciated that the compressor(s) 112 may be scroll compressors, but can be other types of compressors. For example, the compressor(s) 112, may be screw compressor, rotary compressor, reciprocating compressor, and/or centrifugal compressor types.

The condenser 114 is fluidly connected with the compressor(s) 112. The compressors 112 each include a discharge 122 which is fluidly connected with fluid line 126 to the condenser 114. In the embodiment shown, the fluid line 126 is fluidly connected between the two coils of the condenser and feeds two lines from the fluid line to an upper and lower part of each coil or side relative to the fluid line 126. In the embodiment shown, the fluid line 126 is fluidly connected to multiple inlets (e.g. four) branching off the fluid line 126. The condenser 114 is fluidly connected with the evaporator 116 by way of fluid line 128 and fluid line 118, which are liquid lines. In the embodiment shown, the condenser 114 has four outlets (two per coil side) which are in fluid communication with fluid line 128, where there is an outlet for the upper part of the coil and an outlet for the lower part of the coil, and where each side of the condenser has two outlets. In the embodiment shown, the fluid lines 128 fluidly join before a valve, e.g., service valve 129. The evaporator 116 is fluidly connected with the compressor 112 by way of fluid line 119 or suction line. In the figure shown, a single circuit three compressor system is illustrated. The three compressors shown are manifolded together. In an embodiment, each discharge 122 feeds the fluid line 126. In an embodiment, the three compressor discharge lines plum together behind the unit into one common discharge line (e.g. 126).

The evaporator 116 herein can provide good heat transfer performance, capacity, and efficiency and while reducing pressure drop or minimizing its effect therethrough.

In an embodiment, the evaporator 116 is made of multiple coils 117*a*, each having microchannel tubes and has appropriate inlet and outlet headers 117*b*, 117*c* (one set of inlet and outlet headers 117*b*, 117*c* of a coil of microchannel tubes 117*a* are labeled for purposes of description). In an embodiment, the microchannel tubes of a coil 117*a* may have fins disposed between the tubes. As shown, the evaporator 116 has four coils, however, this is exemplary, as less than four or more than four may be implemented.

In an embodiment, the evaporator 116 is implemented in a refrigerant system that is a single circuit. A refrigerant system of a single circuit includes one or more compressors, a condenser, an evaporator, and an expansion device.

In an embodiment, the evaporator 116 is an air to refrigerant type heat exchanger.

In an embodiment, the evaporator 116 has an even number of coils. In an embodiment, the evaporator 116 has its coils configured to be assembled to a height of at or about six feet tall and to a width of at or about eight feet wide. In an embodiment, the coils of the evaporator 116 are of similar or the same size relative to each other. In the embodiment shown, for example, the four coils are the same or about the same size.

In an embodiment, the evaporator 116 includes a distribution to the multiple coils of the multi-coil microchannel evaporator. In an embodiment, the refrigerant distribution to the evaporator 116 includes one or more separations to transmit refrigerant to each of the coils of the evaporator 116 and one or more junctions to transmit refrigerant from the coils.

With specific reference to the evaporator 116, the fluid connections for refrigerant flow into and out of the evaporator 116 are further described below.

As shown in FIGS. 2 and 3, the fluid line 118 delivers refrigerant from the condenser 114 to the evaporator 116. In an embodiment, the fluid line 118 is a liquid fluid line through which refrigerant flows to the evaporator 116. A separation or split 130 at the evaporator will separate the liquid flow to flow through multiple lines. In an embodiment, the separation 130 leads to two fluid lines 132 to deliver refrigerant through one of the lines 132 to a top and bottom coil 117*a* on one side of the evaporator 116 and to deliver refrigerant through the other line 132 to a top and bottom coil 117*a* on the other side of the evaporator 116. It will be appreciated that two fluid lines 132 are shown, however, more than two fluid lines may come from the separation 130 if desired for other designs.

Expansion devices 120 are fluidly connected with the fluid lines 132. The expansion devices 120 further reduce the pressure of the refrigerant, and expand and cool the refrigerant. In an embodiment, one expansion device services multiple coils of the evaporator. For example, each expansion device 120 as shown services two coils 117*a* of the evaporator 116.

In an embodiment, there are multiple expansion devices for a multiple coil evaporator arrangement, where there may be an expansion device for each coil or a number of coils, or sides of coils in the overall evaporator arrangement.

In an embodiment, each expansion device 120 is disposed downstream of the separation 130. In an embodiment, each expansion device 120 is disposed upstream of the separation 134. In an embodiment, the expansion device 120 is disposed between any separations (e.g. 130, 134) of the evaporator. It will be appreciated that the expansion devices 120 may be thermostatic expansion devices (e.g. thermostatic expansion valve TXV), but may also be electronic expansion devices and/or valves. The number and placement of the expansion devices can facilitate the metering of refrigerant evenly through the evaporator, for example by balancing the number of expansion devices per side of the coil or portion of the coil, and depending on the number of coils implemented in the evaporator.

At separation 134, the fluid lines 132 are each separated so that refrigerant can flow through multiple lines. In an embodiment, the separation 134 leads to two fluid lines 136 to deliver refrigerant through one of the lines 136 to one of a top and bottom coil 117*a* on one side of the evaporator 116, and to deliver refrigerant through the other line 136 to the other of the top and bottom coil 117*a* on the same side of the evaporator 116. It will be appreciated that two fluid lines 136 are shown per separation 134, however, more than two fluid lines may come from the separation 130 if desired for other designs.

The fluid lines 136 respectively lead to a coil 117*a*. As shown, each fluid line 136 is fluidly connected with an inlet header 117*b* of a respective coil 117*a*. In the embodiment shown, there are four fluid lines 136, one for each coil 117*a*. The refrigerant flow through the coil 117 to undergo heat exchange (i.e. evaporation) before being directed back to the compressor 112.

From each coil, refrigerant flows through the outlet header 117*b*, the microchannel tubes, and the header 117*c* to a respective fluid line 138. As shown, each fluid line 138 is fluidly connected with a header 117*c* of a respective coil. In the embodiment shown, there are four fluid lines 138, one for each coil.

In an embodiment, a junction 140 receives fluid lines 138 to join the fluid flow at the junction 140. As shown, each of the junctions 140 receives two fluid lines 138 respectively. Two junctions 140 are shown. The junctions 140 are fluidly connected with fluid lines 142. In an embodiment, the junctions 140 leads to fluid lines 142 to deliver refrigerant through the lines 142 to another junction 144. It will be appreciated that the two fluid lines 142 shown is exemplary, for example depending on the junctions 140 needed to join fluid lines which may be dependent for example on the number of coils present.

Junction 144 is in fluid connection with the fluid line 119. In an embodiment, the fluid line 119 is a suction line for evaporated refrigerant to flow back to the compressor 112.

In an embodiment, by having multiple relatively shorter coils along with an intermediate drain pan 150 (see e.g. FIG. 3), there is less chance for water to carryover than if we had taller coils that span from the top of the unit to a bottom drain pan (see e.g. bottom of FIG. 3).

In an embodiment, the distribution arrangement (e.g., the separations/splits and junctions) utilizes the number and size of each coil in the evaporator 116 to obtain a desired, targeted, and/or optimal refrigerant distribution. In an embodiment, the number of coils present in the arrangement can impact the number of separations and junctions to distribute the refrigerant to the evaporator and to exit the refrigerant from the evaporator to suction. Balancing the number of expansion devices, e.g. per coil, per groups of coils, based on side and/or location of the coil arrangement, and the like, can help meter and distribute refrigerant evenly through the evaporator coils.

In an embodiment, the evaporator 116 with its coils, separation/junction, and expansion device arrangement may be implemented and/or optimized in systems with air flows of at or about 200 to at or about 400 cubic feet per minute (CFM).

In an embodiment, a bank of multiple coils is oriented in a vertical orientation, and generally in the same plane (e.g. as shown in FIGS. 2 and 3). It will be appreciated, however, that depending on how the airflow is entering the coil, other designs may also include staggering the coils and/or spacing them in a different orientation relative to each other. For example, one or more of the coils shown in FIGS. 2 and 3 may be moved forward or backward relative to the other coils so that they are not in the same plane, or angled so that they are not all vertically oriented.

In an embodiment, a method of refrigerant flow through a single circuit refrigerant system includes distributing refrigerant to coils of a multi-coil microchannel evaporator, including directing the refrigerant to and from the multi-coil microchannel evaporator using the distribution including its separations and junctions.

In an embodiment, such as for the example shown in FIGS. 2 and 3, airflow can be assumed to be uniform across all coils of the evaporator 116. The multiple coils (e.g. respective tubes 117*a* and headers 117*b, c*), for example the four coils shown in FIGS. 2 and 3 are used to reduce refrigerant pressure drop. In an embodiment, the coils are the same height and width. There are two left hand and two right hand coils. Liquid refrigerant separations or splits from a liquid line (e.g. at split 132 from line 118 into two lines 132, and then to split 134 into two lines 136 after passing through the expansion devices 120). In an embodiment, the left hand top and bottom coils are fed refrigerant using one of the expansion devices 120, which in some embodiments may be a thermal expansion device. The right hand top and bottom coils are fed refrigerant using the other expansion device 120, which may also be a thermal expansion device. After passing through each coil, the refrigerant is combined into one main suction line (e.g. line 119). By having the four coils refrigerant can be distributed to each coil evenly in order to maximize performance.

The Table includes averaged data that represents a unit tested (e.g. with the multi-coil configuration of FIGS. 2 and 3 at 50 ton capacity) at 80/67-95 (Indoor Drybulb/Indoor Wetbulb—Outdoor temperatures). These conditions are the full load rating conditions. The unit was tested with both fin and tube and multi-micro channel evaporator configurations at full load (all components energized—compressors, condenser fan motors, and supply fan motor). The data is compared to a fin and tube evaporator design In general, the data shows similar unit balance points (saturated discharge/suction pressures—Tests/IDs 1 and 2), similar airside pressure drop across evaporator coils (Tests/IDs 3 and 4), similar conditions (Tests/IDs 5 to 7) leaving air Drybulb/Wetbulb temperatures (Tests/IDs 8 and 9).

TABLE

| ID | Test | Units | Fin and Tube Evaporator | Multi-coil Microchannel Evaporator |
|---|---|---|---|---|
| 1 | System saturated discharge | ° F. | 120.9 | 121.9 |
| 2 | System saturated suction | ° F. | 48.6 | 48.7 |
| 3 | Static pressure drop before coil | Inches $H_20$ | −0.32 | −0.35 |
| 4 | Static pressure drop after coil | Inches $H_20$ | −0.93 | −1.07 |
| 5 | Entering indoor Air | ° F. | 80 | 80 |
| 6 | Entering indoor Air | ° F. | 67 | 67 |
| 7 | Outdoor Air | ° F. | 95 | 95 |
| 8 | Leaving indoor Air | ° F. | 58 | 59 |
| 9 | Leaving indoor Air | ° F. | 56 | 56 |

The multiple coil configuration along with the distribution (separations/junctions) internal to the coil provides the proper refrigerant pressure drop to match balance points. By matching balance points, larger ton units/designs have been able to maintain the same efficiency levels as compared against a fin and tube evaporator currently used in smaller designs.

Any one or more of aspects 1 to 6 may be combined with any one or more of aspects 7 to 8, and aspect 7 may be combined with aspect 8.

1. An evaporator comprising: multiple coils, the multiple coils are microchannel tubed coils and a distribution to the multiple coils. The distribution to the multiple coils includes one or more separations to transmit refrigerant to each of the coils of the multi-coil microchannel evaporator and one or more junctions to transmit refrigerant from the coils. Multiple expansion devices are in fluid communication with the separations of the distribution.

2. The evaporator of aspect 1, wherein the evaporator has an even number of coils.

3. The evaporator of aspect 1 or 2, wherein the multiple coils are configured to be assembled to a height of about six feet tall and to a width of about eight feet wide.

4. The evaporator of any of aspects 1 to 3, wherein the coils are of similar or the same size.

5. The evaporator of any of aspects 1 to 4, wherein the distribution utilizes the number and size of each coil in the multi-coil microchannel evaporator to obtain a desired, targeted, and/or optimal refrigerant distribution.

6. The evaporator of aspect 1 to 5, wherein the multiple coils are configured as an air to refrigerant type heat exchanger.

7. A refrigerant compression system, comprising: a single circuit that includes one or more compressors, a condenser, and an evaporator of any of aspects 1 to 6.

8. A method of refrigerant flow through a single circuit refrigerant compression system includes distributing refrigerant through the evaporator of any of aspects 1 to 6.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. An evaporator, comprising:

a plurality of sections of coils, each section of the plurality of sections of coils being separate from each other and containing a plurality of microchannel tubes;

a distribution to the plurality of sections of coils, the distribution to the plurality of sections of coils including:

one or more separations to transmit refrigerant to each section of the plurality of sections of coils, and one or more junctions to transmit refrigerant from each section of the plurality of sections of coils; and a plurality of expansion devices in fluid communication with the one or more separations of the distribution, wherein the plurality of sections of coils form a vertical panel, and an intermediate drain pan is physically disposed between sections of the plurality of sections of coils.

2. The evaporator of claim 1, wherein the plurality of sections of coils includes an even number of sections of coils.

3. The evaporator of claim 1, wherein the plurality of sections of coils are configured to be assembled to a height of about six feet tall and to a width of about eight feet wide.

4. The evaporator of claim 1, wherein coils of the plurality of sections of coils are of similar or the same size.

5. The evaporator of claim 1, wherein the distribution utilizes a number and size of each section of the plurality of sections of coils to obtain a selected refrigerant distribution.

6. The evaporator of claim 1, wherein the plurality of sections of coils are configured as an air to refrigerant type heat exchanger.

7. The evaporator of claim 1, wherein each section of the plurality of sections of coils includes an individual inlet header and an individual outlet header.

8. The method of claim 1, the intermediate drain pan separates sections of the plurality of sections of coils.

9. A refrigerant compression system, comprising:

a single circuit that includes one or more compressors, a condenser, and the evaporator of claim 1.

10. A method of refrigerant flow through a single circuit refrigerant compression system, comprising:

directing refrigerant from a condenser to a distribution of an evaporator, the evaporator having a plurality of sections of coils, each section of the plurality of sections of coils being separate from each other and containing a plurality of microchannel tubes, the directing including directing the refrigerant through one or more separations to transmit the refrigerant to each section of the plurality of sections of coils;

directing the refrigerant from multiple fluid lines to each coil of the plurality of sections of coils to undergo evaporation;

directing the refrigerant from each section of the plurality of sections of coils to one or more junctions; and directing the refrigerant from the one or more junctions to a compressor, wherein the plurality of sections of coils form a vertical panel, and an intermediate drain pan is physically disposed between sections of the plurality of sections of coils to prevent water carryover from top to bottom of the vertical panel.

11. The method of claim 10, wherein each section of the plurality of sections of coils includes an individual inlet header and an individual outlet header.

* * * * *